United States Patent [19]

Ruehl

[11] Patent Number: 5,040,783

[45] Date of Patent: Aug. 20, 1991

[54] ROTARY STACKER

[75] Inventor: Kenneth L. Ruehl, Cincinnati, Ohio

[73] Assignee: The Procter & Gamble Company, Cincinnati, Ohio

[21] Appl. No.: 580,395

[22] Filed: Sep. 10, 1990

[51] Int. Cl.[5] ..... B65H 39/10

[52] U.S. Cl. ..... 271/300; 271/70; 271/315; 271/187; 271/213; 414/790.9; 414/791.1; 414/793.9

[58] Field of Search ..... 271/66, 70, 72, 83, 271/187, 189, 279, 280, 300, 315, 213; 414/790.9, 791.1, 793.9

[56] References Cited

U.S. PATENT DOCUMENTS

| | | | |
|---|---|---|---|
| 700,238 | 5/1982 | Read | 414/793.9 |
| 3,531,108 | 9/1970 | Rabinow et al. | 271/64 |
| 3,744,790 | 7/1973 | Hoffman | 271/64 |
| 3,894,479 | 7/1975 | Anikobov et al. | 414/793.9 |
| 4,088,314 | 5/1978 | Phillips | 271/187 |
| 4,434,979 | 3/1984 | Kobler et al. | 271/307 |
| 4,511,136 | 4/1985 | Yamada et al. | 271/315 |
| 4,522,387 | 6/1985 | Leuthold | 271/187 |
| 4,523,671 | 6/1985 | Campbell | 198/422 |
| 4,595,193 | 6/1986 | Nakamura | 271/187 |
| 4,736,936 | 4/1988 | Hertel et al. | 270/58 |

FOREIGN PATENT DOCUMENTS

| | | | |
|---|---|---|---|
| 291363 | 12/1986 | Japan | 271/187 |

*Primary Examiner*—H. Grant Skaggs

*Attorney, Agent, or Firm*—John V. Gorman; Thomas H. O'Flaherty; Richard C. Witte

[57] ABSTRACT

A stacking device for forming stacks of articles of predetermined count, using a stacking wheel having a multiplicty of uniformly spaced peripheral slots. The slots are adapted to receive articles sequentially at a loading station and carry them to an unloading station having a plurality of stacking sites. The slots are divided into two or more sets, the slots in each set being equal to number to the predetermined count and adapted to deliver the articles therein to the unloading station with the leading edges of the articles at a predetermined radial offset from the axis of the stacking wheel. Each set of slots is associated with the stacking of articles at a specific stacking site and the slots of a set associated with one stacking site provide a different radial offset than those of a set associated with another stacking site. The stacking sites are arranged, in the downstream direction, in order of diminishing radial offset of their associated sets of slots. Separation of the stacks is effected by having stripping fingers for each stacking site act at the appropriate radial offset.

18 Claims, 4 Drawing Sheets

ROTARY STACKER

TECHNICAL FIELD

This invention relates to a stacking device and, more particularly, to a rotary stacking device for high speed stacking of articles of predetermined count for subsequent processing and/or packaging operations.

BACKGROUND INFORMATION

During the course of manufacturing articles such as facial tissues, sanitary napkins, diapers, and other such objects, it is often required that serially fed articles be taken from a conveyor, accumulated in stacks of predetermined count and the stacks advanced for further processing and/or packaging. This has been done both manually and by various mechanisms throughout the years. In connection with machinery adapted to perform such functions, these frequently include slotted wheels to carry the articles from the conveyor to a discharge station at which the articles could be stacked, shingled, or the like. For example, Leuthold U.S. Pat. No. 4,522,387, which issued on June 11, 1985 discloses a device for stacking sheets which comprises several disks arranged adjacent one another on a shaft. The disks have spiral slots formed in them which extend from the periphery towards their centers. Corresponding slots overlap in an axial direction and form pockets, each of which is adapted to receive a sheet. The spiral slots of adjacent disks are staggered to exert frictional force on the incoming sheets to dissipate their kinetic energy. As the disks rotate, the sheets are removed from the slots by a pick-off arranged between the disks and stacked on a tray. Presumably, they are manually removed from the tray on which they are accumulated.

Similarly, Rabinow et al, U.S. Pat. No. 3,531,108, issued Sept. 29, 1970, concerns a document stacker and/or sorter employing a number of stacking wheels having curved slots for document pockets. As the stacking wheels rotate, a stripping device operatively associated with each removes the documents from the respective pockets and stacks them neatly in a tray. No means is shown to remove the stacks, so presumably this is also accomplished manually.

In Hertel U.S. Pat. No. 4,736,936, issued on Apr. 12, 1988, apparatus is described for stacking and removing articles of predetermined count. The articles are fed sequentially into slots in a rotating wheel. As the articles follow their circular path, they are stripped and stacked on buckets carried by a conveyor moving along an intersecting path. When the stack of articles on one bucket is completed, the bucket progresses from a stripping position and the next subsequent bucket is rapidly moved into stripping position. Ultimately, each loaded bucket is aligned with another conveyor and its stack withdrawn and carried by the other conveyor to an accumulation station. Thereafter, the empty buckets return in sequence to the stripping position. This interaction between moving machine parts involves timing, position and clearance problems which will hamper efforts to move in the direction of high speed operation.

The sheet stacking apparatus disclosed in Nakamura, U.S. Pat. No. 4,595,193, issued June 17, 1986, involves a blade wheel having slots wherein sheets are inserted and carried to a stripping/stacking station, at which they are removed and separated into units of predetermined number. The apparatus uses a separator rotably mounted about the same axis as the blade wheel and intermittently operated in unison therewith to position itself between the last sheet of one stack and the first sheet of the next. The separator is then held stationary while the completed stack is removed. During the removal process, subsequent sheets accumulate on the separator. Thereafter, these sheets are transferred to the stacking means as the separator is rotated to its standby position adjacent the sheet infeed means. It will be apparent that this apparatus, too, could be difficult to operate at high production rates because it involves synchronous coordination of dynamic machine elements.

Other teachings relative to shingling, sorting and stacking of articles are found in Kobler et al U.S. Pat. No. 4,434,979, issued on Mar. 6, 1984; Hoffman U.S. Pat. No. 3,744,790, issued on July 10, 1973; and Campbell U.S. Pat. No. 4,523,671, issued June 18, 1985.

SUMMARY OF THE INVENTION

It is an object of the present invention to provide a high speed stacking mechanism.

It is a further object of the present invention to provide a high speed stacking mechanism to effect an accurate count and separation of articles into discrete stacks of predetermined number.

It is another object of the present invention to provide a stacking mechanism to accumulate stacks of articles of known count with a minimum of interacting moving parts and having the capability of handling articles having a broad spectrum of physical properties.

In accordance with one aspect of the present invention there is provided a stacking device for forming stacks of articles of predetermined count. The stacking device comprises a rotary transport means for conveying the articles sequentially from a loading station to an unloading station having a plurality of stacking sites. The rotary transport means has an axis of rotation and a multiplicity of pockets spaced about its periphery and adapted to receive the individual articles. The pockets are divided into a plurality of sets, each of which has a multiplicity of pockets equal in number to the predetermined count. The pockets in each set are adapted to deliver articles to the unloading station with the leading edges of the articles at approximately the same radial offset from the axis of rotation. The radial offset for one set differs from that of another set. Means is provided to remove the articles from the pockets and accumulate the articles in stacks at the stacking sites. The article removal means employs the differing radial offsets to effect segregation of the group of articles carried by one set of pockets from those of another set.

In accordance with another aspect of the present invention there is provided a method of forming stacks of articles or predetermined count. The method comprises feeding the predetermined count of articles into a first set of peripheral pockets of a rotating stacking wheel to a generally uniform first depth. The articles in the first set of pockets are then carried to an unloading station at which a stripping means, acting at the first depth, strips the articles from the first set of pockets and guides them to a first stacking site, at which the articles are accumulated. Next, the predetermined count of articles is fed into a second set of peripheral pockets of a rotating stacking wheel to a generally uniform second depth. The articles in the second set of pockets is carried to an unloading station at which a stripping means, acting at the second depth, strips the articles from the second set of pockets and guides them to a second stacking site, at which the articles are accumulated. The stack of accumulated articles are removed from the first stacking site while articles are being accumulated at the second stacking site and vice versa.

BRIEF DESCRIPTION OF THE DRAWINGS

While the specification concludes with claims particularly pointing out and distinctly claiming the subject invention, it is believed that the same will be better understood from the following description, taken in conjunction with the accompanying drawings in which:

DESCRIPTION OF THE PREFERRED EMBODIMENT

Figure 1:
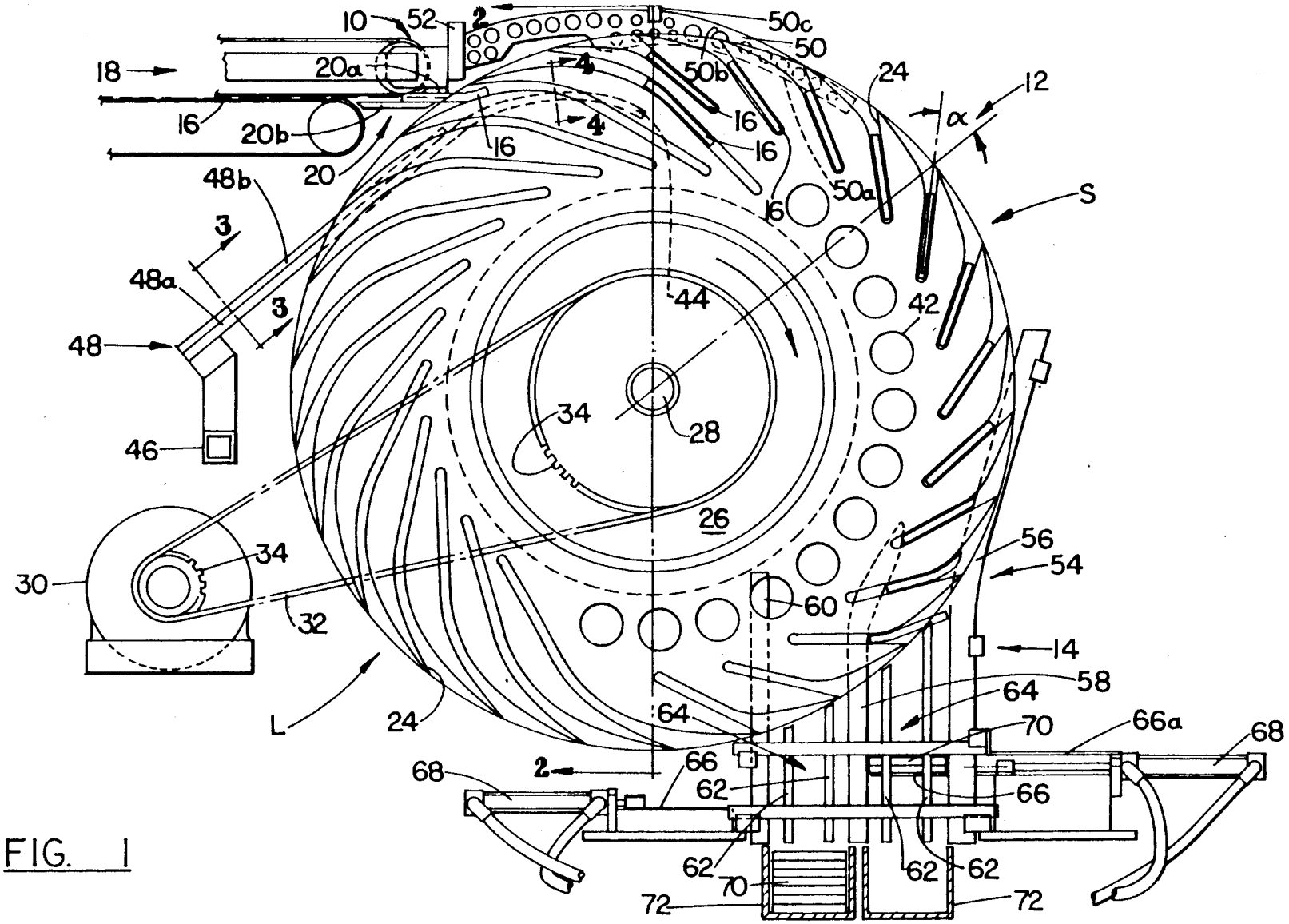
Fig. 1 is a fragmentary plan view, partially schematic, of the rotary stacking device of the present invention.

Referring now to the drawings in detail, wherein like numerals indicate the same element throughout the views, there is shown in FIG. 1 a rotary stacking device generally comprising a loading station 10, a rotary transport means 12 and an unloading station 14. The rotary stacking device is intended to produce stacks of 156 count two-ply facial tissues. In the illustrated embodiment, articles comprising clips 16 of facial tissues (i.e. small stacks comprising twelve facial tissues each) are conveyed in spaced relationship at high speed to the loading station 10. The clips 16 are carried flat, between the belts of double flat belt conveyor 18, oriented with the tissue length transverse the direction of travel at a spacing of about 14", or so. At the downstream end of conveyor 18, a product delivery nozzle 20, comprising spaced plates **20*a* and 20*b* are provided to guide the clips 16 being ejected at high speed from the conveyor 18 to the periphery of rotary transport means 12 in such a way as to prevent the tissues constituting the clips 16 from separating, thus complicating the loading operation. In effect, the nozzle 20 funnels each clip 16 into a pocket on the periphery of rotary transport means 12**.

Figure 2:
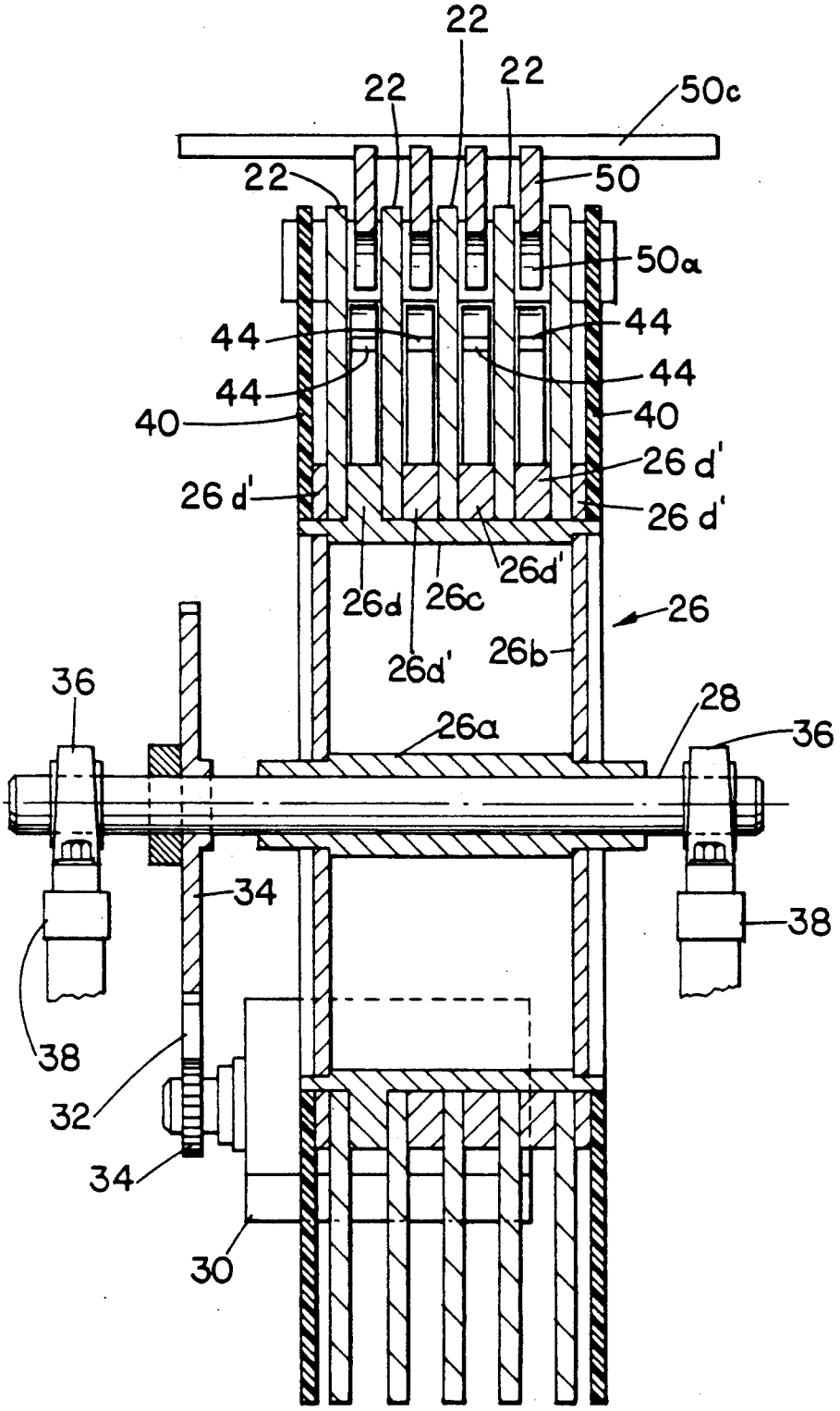
FIG. 2 is an enlarged fragmentary vertical sectional view taken along line 2—2 of Fig. 1, the view being simplified by the omission of the infeed conveyor, the slots in the stacking wheel, the articles being carried in the slots and the balancing holes.
Figure 3:
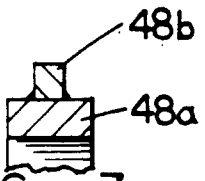
FIG. 3 is an enlarged cross-sectional view of the deceleration rail support taken along line 3—3 of FIG. 1.

The rotary transport means 12, as shown in FIGS. 1 and 2, can comprise a stacking wheel having a plurality, in this case five, of identical, spaced disks 22 having equally spaced peripheral slots 24 machined therein. The disks 22 are mounted on a hub 26 keyed to shaft 28 driven by a phase shifting differential transmission 30 by means of timing belt 32 and timing belt pulleys 34. The phase shifting differential transmission 30 is driven at a speed bearing a constant relationship with the speed of the conveyor 18 such that the number of slots 24 passing through the loading station 10 per unit of time is equal to the rate of delivery of clips 16 thereto. Its output, and therefore the rotary transport means 12 driven by it, can be phase adjusted to facilitate presenting a slot for loading concurrently with the arrival of a clip 16 at loading station 10. Shaft 28 is rotatably supported on bearings 36 attached to supports 38.

As shown most clearly in FIG. 2, hub 26 is fabricated from arbor **26*a*, end plates 26*b* and cylindrical side wall 26*c*, which can be fitted together and welded for rigidity. The side wall 26*c* has an integral annular spaced ring 26*d* projecting outwardly from its outer surface. The ring 26*d* is so positioned axially on the hub and has sufficient strength to assure both proper positioning of disks 22 and their rigid securement to hub 26. The disks 22 slide onto the outer periphery of side wall 26*c*, alternating with separate ring spacers 26*d*', and guard/guide disks 40 of clear plastic are applied on the outer surface of each end of the hub 26 side wall 26*c*. The disks 22, spacers 26*d*' and guard/guide disks 40 can be secured to the integral spacer 26*d*** by means of bolts or the like.

Referring now to FIG. 1, each of the disks 22 has two sets of slots 24. The set of shorter slots 24, which is instantaneously shown at the right side of stacking wheel 12 and 13 indicated generally as S, comprises slots 24 equal in number to the number of clips 16 to be included in each stack to be formed—in this case thirteen. Similarly, the set of longer slots at the left side of FIG. 1, indicated generally as L, comprises thirteen slots for like reason. Because of the illustrated differences, the clips 16 to be carried in the slots 24 of set S will move toward unloading station 14 with the leading edges thereof radially offset from the axis of shaft 28 by a distance exceeding the corresponding radial offset of clips 16 to be carried in slots 24 of set L. As will be understood from subsequent description, this difference is used as a basis for separately stacking clips from set S and set L. When the five disks 22 are secured to hub 26, the corresponding slots 24 of sets S and L of the assembled disks 22 are axially aligned and cooperatively form sets of pockets adapted to receive and support the clips 16 as they are carried to the unloading station 14.

Entry angle $\alpha$ of a slot 24 is the included angle between the center line of the entry portion of the slot 24 and a radial line passing through the point on the periphery of the disk 22 intersected by the center line. For the slots 24 comprising set S, $\alpha$ can be about 45°. For slots 24 comprising set L, $\alpha$ can be about 60°. These angular differences and the shape of the inner ends of slots 24 in set L are principally based on the desired attitude of a clip 16 as it is removed at the unloading station 14 and the values will change from setup to setup. As will be seen, the angular difference can also be useful in applying a braking force to clips 16 entering slots 24 of set S without affecting those entering set L.

Because of the greater volume of material removed in forming the slots 24 of set L, as compared with that in forming shorter slots 24 of set S, a multiplicity of holes 42 are drilled in disks 22 in order to approximately dynamically balance each disk 22 prior to assembly. In view of the relatively large number of pockets on its periphery, the rotary transport means 12 need not operate at high RPM to achieve high speed stacking rates and, hence, precision balancing is not critical.

The velocity of clips 16 being ejected from the conveyor 18 should be sufficient for the resulting kinetic energy to carry the clips 16 to the inner end of the pockets formed by the long slots 24, i.e. the slots 24 in sets L of each disk 22. Since many variables are present, such as the frictional characteristics of the materials, the mass and flexing properties of clips 16, the length of the long slots 24, the angle of entry and contour of the long slots 24, and the like, such velocity will vary from setup to setup, even where the converting speed is held constant. Velocities in the range of 1500 to 2000 feet per minute might well be required where stacking is performed at high speed in a typical application.

Since the velocity of the clips 16 is gauged to carry them to the end of the long slots 24, it will be understood that such velocity will cause the clips 16 entering short slots 24, i.e. the slots 24 comprising sets S in each disk 22, to reach the inner ends of short slots 24 with considerable momentum remaining, unless provision is made to prevent it. Such momentum could cause the clips 16 to buckle or be compressed transversely or, possibly, bounce outwardly in the slots 24, away from such ends in an uncontrolled manner. To eliminate such problems, a deceleration rail 44, See FIGS. 1 through 5, is provided between adjacent disks 22 in the vicinity of loading station 10. Each of the rails 44 is curvilinear and is designed and positioned so that the rail 44 will not contact clips 16 in long slots 24 but will contact clips 16 in the short slots 24, because of the difference in entry angles $\alpha$. In the illustrated embodiment, a radius of curvature of about 15" (38 cm) has been used on a stacking wheel 12 having an outside diameter of about 42" (107 cm).

Figure 4:
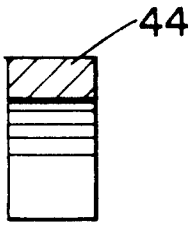
FIG. 4 is an enlarged cross-sectional view of the deceleration rail taken along line 4—4 of FIG. 1.
Figure 5:
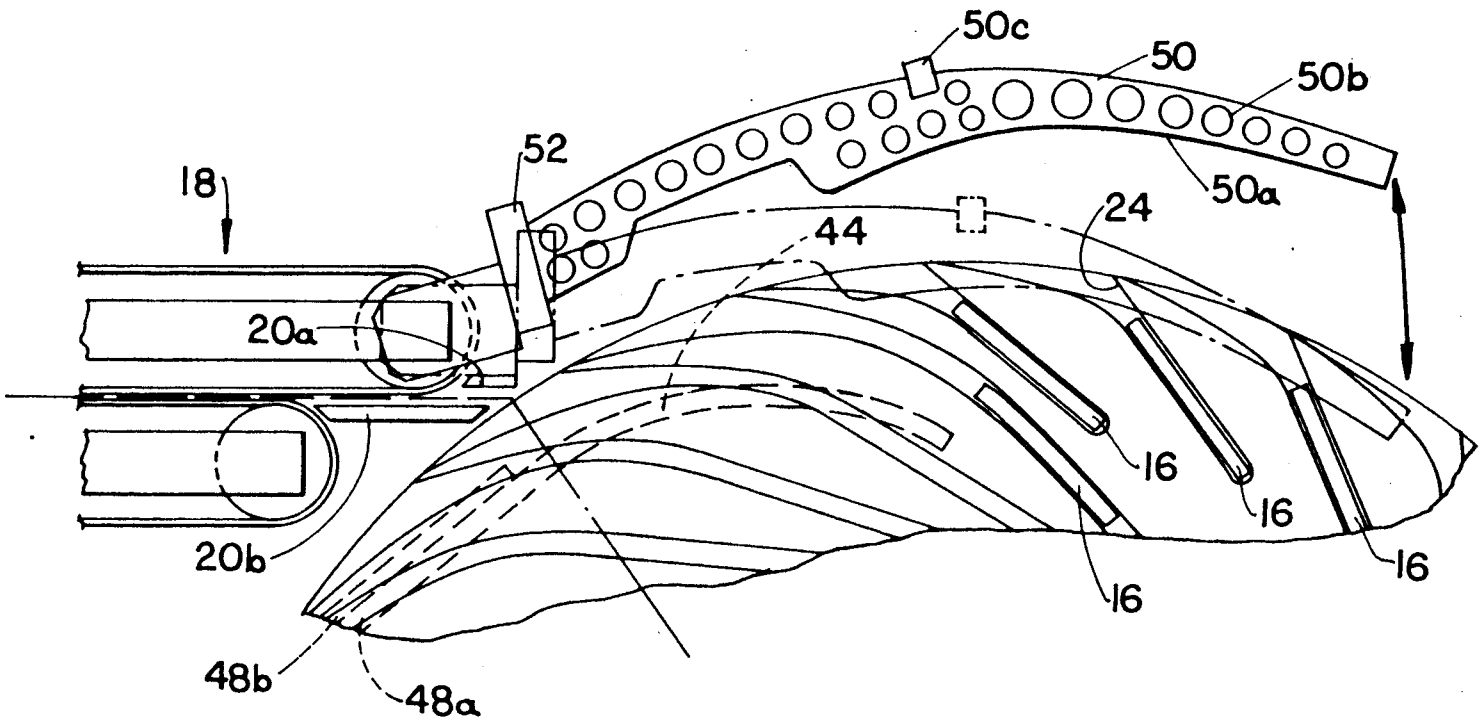
FIG. 5 is an enlarged, fragmentary plan view illustrating the containment rail of the stacking device of FIG. 1 in raised condition to facilitate access to interior of the stacking wheel in the vicinity of the infeed conveyor at the loading station.

As shown, the four deceleration rails 44 are individually cantilevered from rectangular support 46 by means of an assembly 48, wherein a support bar 48*a*, integral with curvilinear rail 44, and a vertical reinforcing member 48*b* are welded together, see FIG. 4, for improved section modulus and, so, greater resistance to bending. As a clip 16 moves inwardly in short slots 24 and the rotary transport means 12 rotates in a clockwise direction away from loading station 10, the leading edge of the clip 16 contacts the apparently receding, but stationary, upper face of deceleration rail 44, to an extent such that the clip 16 velocity relative to the short slots 24 is small, or zero, as it reaches the inner ends of the short slots 24. The support 46 is preferably adjustable, rotationally and in the X–Y plane, to compensate for changes in speed, materials and the like and to simplify the design of rails 44.

As rotary transport means 12 rotates away from the loading station 10, means is provided for positive positioning of the clips 16 in short slots 24. Containment rails 50, see FIGS. 1,2 and 5, each of which has an arcuately shaped inner surface 50*a*, are supported between adjacent disks 22, with arcuate surface 50*a* positioned to contact the outer edges of projecting clips 16 to force them inwardly to a fully inserted position in the short slots 24. The rails 50 are cantilevered from support bar 52, mounted for arcuate movement between an access position, shown in solid lines in FIG. 5, and an operating position, shown in phantom lines, about the center of the end roller of the upper run of conveyor 18. Containment rails 50 are lightweighted by drilling holes 50*b* therethrough. A bar 50*c* extends across and connects the top central portions of the rails 50 to increase rigidity of the assembly and provide a handle to lift the rails 50 to the access position.

Figure 6:
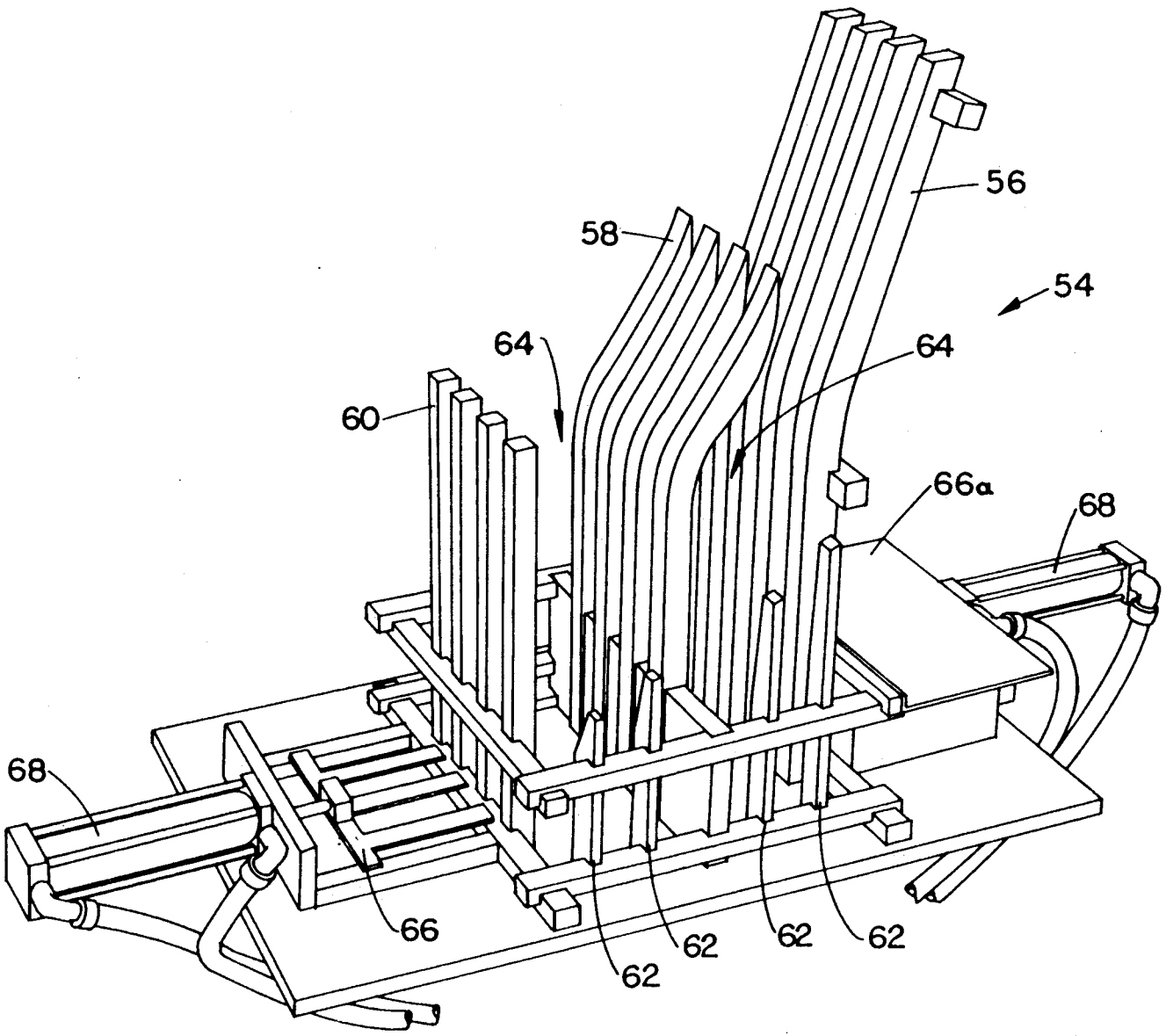
FIG. 6 is an enlarged, fragmentary perspective view illustrating the stripper assembly of the stacking device of FIG. 1.

The stripper assembly 54 of unloading station 14 is illustrated in FIGS. 1 and 6. It is comprised of three sets of upstanding rails which are positioned intermediate adjacent disks 22: outer guide rails 56, short pocket stripping/guide rails or fingers 58 and deep pocket stripping/guide rails or fingers 60. End guide rails 62 are provided at each end of the stacking sites 64 which lie intermediate adjacent sets of upstanding rails, i.e. one between outer guide rails 56 and short pocket stripping fingers 58 and another between short pockets stripping fingers 58 and deep pocket stripping fingers 60. The upper portions of guide rails 62 have lead-in tapers to correct any axial (transverse) misalignment of clips 16 as they descend into the stacking sites. The various rails and fingers 56, 58, 60 and 62 thus perform a guiding function in funneling clips 16 into the stacking site 64 associated with the pockets of the set S or L slots 24 from which the clips 16 are being stripped and in forming the peripheral limits of the stacking sites 64.

As shown most clearly in FIG. 6, vertical support at stacking sites 64 is provided by slide gates 66 at each side of the stripper assembly 54. The slide gates 66 are mounted for reciprocating movement on the piston rods of air cylinders 68 and are slotted to permit movement transverse and beyond the adjacent bank of rails 56 or fingers 60. The slide gates 66 are each movable from a withdrawn position (as illustrated for the slide gate 66 on the left side of stripper assembly 54 in FIGS. 1 and 6) to the stacking position shown as illustrated for the slide gate 66 on the right side of stripper assembly 54 in FIG. 1. For safety reasons a guard 66*a* should enclose the moving parts, as shown only on the right side of stripper assembly 54. It should be noted that the slide gate 66 for the upstream stacking site 64 is at a higher elevation than the other in order to minimize the vertical drop of the individual clips 16 into the stacking sites 64.

The movement of a slide gate 66 from the stacking position to the withdrawn position is timed to occur about the time a stack 70 has been completed in the stacking site 64 with which the gate 66 is associated and is abrupt, withdrawing vertical support from beneath the stack 70 to permit the stack 70 to drop from stacking site 64 to underlying lateral transport means 72 such as a bucket conveyor, belt conveyor or other mechanism designed to move the stack 70 to another location for packaging or further processing. The movement of a slide gate 66 to the stacking position from the withdrawn position is timed to occur following the descent of the upper surface of stack 70 to a position below the level of slide gate 66. Proper sequencing of these movements can be accomplished with shaft 28 position sensors such as an electronic shaft encoder, programmable limit switches, cams or other equivalent means well known to those skilled in the art.

With the stripper assembly set up as shown in FIG. 1, the short pocket stripping fingers 58 are intermediate adjacent disks 22, projecting interiorly of the rotary transport means 12 to a stripping position which is radially offset from the axis of shaft 28 by an amount which matches the radial offset of the leading edges of clips 16 as they are carried into the unloading station 14 within the pockets formed by short slots 24 of set S. Similarly, the deep pocket stripping fingers 60 are between adjacent disks 22 and project interiorly of the rotary transport means 12 to a stripping position which is radially offset from the axis of shaft 28 by an amount which is equal to the radial offset of the leading edges of clips 16 as they are carried into the unloading station 14 within the pockets formed by longer slots 24 of Set L. It will be noted that the stripping positions for the stacking sites 64 are arranged, in the direction of rotation of the stacking wheel, in order of diminishing radial offset.

As the rotary transport means 12 rotates in the clockwise direction, the stationary short pocket stripping fingers 58 strip the clips from the pockets as they move through the unloading station 14 and with the cooperation of outer guide rails 56 guide the clips 16 into the associated stacking site 64, where they are accumulated on top of slide gate 66. When the thirteen clips 16 carried in the pockets formed by short slots 24 of set S have been stacked and the last such pocket is moving past the stripping position, the shaft 28 position sensor provides a signal which actuates the associated air cylinder 68, moving the slide gate 66 to its withdrawn position. The stack 70 is therefore released and falls below the level of slide gate 66, to lateral transport means 72, which removes it for subsequent operations. Then, the shaft 28 position sensor provides a signal which again actuates the associated air cylinder 68, causing it to move the slide gate 66 in an opposite direction, into the stacking position.

As the accumulated stack 70 in the stacking site associated with the pockets formed by slots 24 of set S is being dropped and removed, the clips 16 in the pockets formed by long slots 24 of set L have advanced to unloading station 14, where stationary deep pocket stripping fingers 60 contact their leading edges. The clips 16 are thereby stripped from their pockets and, with the cooperation of the downstream (rear) side of short pocket stripping fingers 58, guided into the associated stacking site 64, shown on the left side of pickoff or stripper assembly 54. When all thirteen clips 16 carried by the pockets formed by slots 24 of set L have accumulated at the associated stacking site 64, the stack 70 is dropped and removed in the same manner as described above with the other stacking site 64. As the stack 70 is dropped and removed from the left side stacking site, accumulation of the clips 16 for the next stack 70 commences at right hand stacking site 64. Thus, stacks 70 are alternately formed in one stacking site 64 and then the other, with completed stacks removed from one stacking site 64 while the stack 70 is accumulating on the other and vice versa.

In the illustrated embodiment, the radial offset of an article carried by a pocket depends principally on the length of the slots 24 which form the pockets, i.e. the location of the innermost ends of the slots. If desired, the effective length of slots 24 could be adjusted by supplemental deceleration or friction devices or stops, not shown, acting on articles moving along the slots 24 and adapted to stop such articles at predetermined radial offsets which are different from those of the actual inner ends of the slots.

Although the rotary transport means 12 described above has two sets of pockets, it is possible to increase its diameter, for example, and provide three, four or more sets of pockets. Stacking sites 64 could be provided for each set or, possibly, each stacking site 64 could be shared for non-adjacent sets of pockets. Also, while it is preferred to have the pockets comprising each set consecutive on the rotary transport means, such is not essential so long as stacking time at one or more sites is sufficient to permit removal of an accumulated stack at another. It will be obvious to those skilled in the art that various changes and modifications can be made in the described embodiment without departing from the spirit and scope of the invention. The terms used in describing the invention are used in their descriptive sense and not as terms of limitation. Accordingly, the following claims are intended to embrace such equivalent changes, modifications and applications which are within the scope of this invention.

What is claimed is:

1. A stacking device for forming stacks of articles of predetermined count, said stacking device comprising:

(a) rotary transport means for conveying said articles sequentially from a loading station to an unloading station having a plurality of stacking sites, said rotary transport means having an axis of rotation and a multiplicity of pockets spaced about its periphery, the pockets being adapted to receive individual articles, (b) the said pockets being divided into a plurality of sets, each set comprising pockets equal in number to said predetermined count, the pockets in each set being adapted to deliver articles to the unloading station with the leading edges of the articles at approximately the same radial offset from said axis of rotation, the radial offset for one set differing from that of another set, and (c) means to remove the articles from said pockets and accumulate the articles in stacks at said stacking sites, such article removal means employing the said differing radial offsets to effect segregation of the group of articles carried by one set from those of another set.

2. The stacking device of claim 1 in which the pockets comprise generally axially aligned slots formed in spaced disks.

3. The stacking device of claim 2 in which the radial offset of an article carried by a slot is controlled principally by the effective length of the slot.

4. The stacking device of claim 3 in which the entry angle of the longer slots is greater than that of shorter slots.

5. The stacking device of any of claims 1–4 in which deceleration rails coact with the articles entering the set of pockets adapted to provide the largest radial offset.

6. The stacking device of claim 1 in which the article removal means comprises a pick-off associated with each stacking site, each pick-off being adapted to act at a radial offset matching that of the leading edges of articles carried by a set of pockets, whereby the articles carried by the matching set of pockets will be stripped therefrom and stacked at the site during each machine cycle, and the stacking sites are arranged, in the direction of rotation of the rotary transport means, in order of associated pick-offs acting at diminishing radial offset.

7. The stacking device of claim 6 in which the number of stacking sites is equal to the number of sets of pockets.

8. The stacking device of claim 7 in which the number of sets of pockets is two.

9. The stacking device of claim 6 in which each pick-off comprises at least one stripping finger adapted to contact the leading edge of each article in a set of pockets to strip the articles from the pockets and guide the articles to the associated stacking site.

10. The stacking device of claim 1 in which containment rails overlie the outboard ends of the pockets between the loading and unloading stations to properly seat articles in the pockets.

11. The stacking device of claim 1 in which the pockets in each set are consecutive.

12. The stacking device of claim 1 which includes means to remove a completed stack of articles from one stacking site while articles are being stacked at another stacking site.

13. The stacking device of claim 12 in which the means to remove a completed stack of articles at each stacking site includes a slide gate, said slide gate being adapted for selective lateral movement between a withdrawn position and a stacking position in timed relationship with the accumulation of stacks at the associated stacking site, said slide gate in the stacking position providing vertical support for an accumulating stack and, when moved to withdrawn position, abrupt vertical deposit of the completed stack onto lateral transport means.

14. The stacking device of claim 1 in which the loading station includes an infeed conveyor carrying consecutive said articles in uniformly spaced relationship synchronized with the arrival of the pockets of the rotary transport means at said loading station.

15. The stacking device of claim 1 or 14 in which a product delivery nozzle guides said articles to a point closely adjacent the periphery of said rotary transport means at said loading station.

16. A stacking device for forming stacks of articles of predetermined count, said stacking device comprising:

(a) rotary transport means for conveying articles sequentially from loading station to an unloading station, said rotary transport means having an axis of rotation and a multiplicity of article-receiving pockets spaced about is periphery;

(b) said unloading station having a plurality of stacking sites, each of which includes an associated pick-off, each of said pick-offs being adapted to act at a stripping position radially offset from said axis of rotation, such radial offset differing from one to another;

(c) the pockets being arranged in a plurality of sets, each set comprising consecutive pockets equal in number to said predetermined count and adapted to carry articles to the stripping position of an associated pick-off with adjacent sets of pockets on said rotary transport means being adapted to carry the articles to different pick-offs; and (d) said stacking sites being arranged in the direction of rotation of the rotary transport means, in order of diminishing radial offsets of associated pick-off stripping positions.

17. A stacking device for forming stacks of articles of predetermined count, said stacking device comprising:

(a) a rotatable stacking wheel having peripheral slots arranged in a plurality of sets, the slots comprising each set being consecutive, equal in number to said predetermined count and extending inwardly to depths generally uniform in radial offset from the axis of rotation of the stacking wheel, the radial offset differing from set-to-set, and (b) an unloading station comprising stacking sites equal in number to the number of sets of slots, each of the stacking sites having a pick-off associated therewith which acts at a stripping position having a radial offset from said axis of rotation matching that of one of the sets with only one pick-off adapted to act on any set, the stacking sites being arranged, in the direction of rotation of the wheel, in order of diminishing radial offset in the stripping positions of associated pickoffs.

18. The method of forming stacks of articles of predetermined count, said method comprising:

(a) feeding the predetermined count of articles into a first set of peripheral pockets of a rotating stacking wheel to a generally uniform first depth, (b) carrying said articles in said first set of pockets to an unloading station at which a stripping means, acting at said first depth, strips the articles from said first set of pockets and guides them to a first stacking site, at which the articles are accumulated, (c) feeding the predetermined count of articles into a second set of peripheral pockets of a rotating stacking wheel to a generally uniform second depth, (d) carrying said articles in said second set of pockets to an unloading station at which a stripping means, acting at said second depth, strips the articles from said second set of pockets and guides them to a second stacking site, at which the articles are accumulated, and (e) removing a stack of accumulated articles from said first stacking site while articles are being accumulated at said second stacking site and vice versa.

* * * * *